United States Patent [19]

Rubin

[11] Patent Number: 4,741,052

[45] Date of Patent: May 3, 1988

[54] HAND COVERING FOR USE WITH FIREARMS

[75] Inventor: Howard J. Rubin, Weston, Conn.

[73] Assignee: Kombi Ltd., Naugatuck, Conn.

[21] Appl. No.: 939,415

[22] Filed: Dec. 8, 1986

[51] Int. Cl.[4] ..... A41D 13/00; A41D 19/00; A41D 27/02

[52] U.S. Cl. ..... 2/161 A; 2/163; 2/164; 2/167; 2/158

[58] Field of Search ..... 2/158, 161 R, 161 A, 2/163, 164, 167

[56] References Cited

U.S. PATENT DOCUMENTS

| | | | |
|---|---|---|---|
| 2,380,633 | 7/1945 | Daiber | 2/158 |
| 3,608,093 | 9/1971 | Kirby | 2/163 |
| 4,214,321 | 7/1980 | Nuwayser | 2/167 |
| 4,430,759 | 2/1984 | Jackrel | 2/167 X |
| 4,662,006 | 5/1987 | Ross, Jr. | 2/158 |
| 4,679,257 | 7/1987 | Town | 2/164 |
| 4,700,405 | 10/1987 | Sternberg | 2/161 A |

FOREIGN PATENT DOCUMENTS

| | | | |
|---|---|---|---|
| 811997 | 4/1959 | United Kingdom | 2/167 |
| 904804 | 8/1962 | United Kingdom | 2/158 |

OTHER PUBLICATIONS

Catalog of L. L. Bean, Inc., 1984, p. 19.

*Primary Examiner*—Wm. Carter Reynolds
*Attorney, Agent, or Firm*—James & Franklin

[57] ABSTRACT

A glove or mitten includes a relatively thick insulating inner layer and an outer cover layer. The outer layer has an extra trigger finger receiving stall situated in front of the conventional trigger finger receiving stall. The single trigger finger receiving stall of the inner layer is received within the conventional trigger finger receiving stall of the outer layer. An opening, proximate the trigger finger receiving stall of the inner layer, permits the trigger finger of the wearer to extend through the inner layer and into the extra trigger finger receiving stall of the outer layer. Because the extra trigger finger receiving stall of the outer layer has no thick insulating inner layer therein, the trigger finger, when situated therein, can manipulate the trigger. Thus, the hand covering need not be removed to use the firearm. A waterproof, vapor permeable thin membrane intermediate layer may be provided.

2 Claims, 6 Drawing Sheets

HAND COVERING FOR USE WITH FIREARMS

The present invention relates to hand coverings and, in particular, hand coverings for use by persons using firearms in inclement weather and, more particularly, to a hand covering which has an additional trigger finger receiving stall of reduced bulk to permit use of a firearm without removal of the hand covering.

Hunters, marksmen, police, and armed forces personnel are often in cold and/or wet weather when it is necessary to use firearms. Hands exposed to such weather for periods of time become stiff and painful, preventing same from being effective in the use of firearms.

Hand coverings such as gloves and mittens of various types, including those which are water-proof, are and have been available for the protection of the hands from the cold and/or wetness. However, in order to be effective, such hand coverings normally require a heat insulating inner layer of relatively thick material which serves to retain body heat.

In order to use a firearm effectively, it is necessary that the trigger finger be situated on the trigger and manipulated to squeeze the trigger in an accurate manner. Because the bulk of most hand coverings, it is necessary to remove the hand covering prior to using the firearm, an operation which is time consuming and resulting in the exposure of the hand to the elements. Such exposure can be detrimental, even after a short period of time, in very inclement weather in that the fingers or hand can become stiff and/or frozen, making same ineffective to accurately use the firearm.

It is, of course, possible to manufacture a hand covering without a trigger finger receiving stall. Such would permit the remainder of the hand to be protected from the inclement weather while the trigger finger is in use. However, this would result in a trigger finger being continuously exposed—a distinct disadvantage as this is the very portion of the body which must be supple and function accurately.

The general object of the present invention is to provide a hand covering which will provide normal heat insulating and protection from the environment for the entire hand at all times. It will provide normal insulation and protection for the trigger finger when the trigger finger is not in use on the firearm and will provide lesser, but sufficient, protection for the trigger finger when the trigger finger is in use on the firearm and, at the same time, permit the accurate manipulation thereof. This object is achieved by providing the hand covering with two trigger finger receiving stalls, one which is provided with normal insulation for use when the trigger finger is not active, and a second stall, which has no heat insulating inner layer and, hence, is much less bulky, providing complete freedom of movement, although a lesser degree of heat insulation, for use when the trigger finger is positioned on the firearm.

It is, therefore, a prime object of the present invention to provide a hand covering for use with firearms.

It is another object of the present invention to provide a hand covering for use with firearms which can be fabricated in the form of a glove or a mitten.

It is another object of the present invention to provide a hand covering for use with firearms which comprises two separate trigger finger receiving stalls, one of which is heavily insulated and relatively thick and the other of which has less insulation and which permits free manipulation of the finger.

It is another object of the present invention to provide a hand covering for use with firearms which includes a waterproof, gas pervious membrane.

It is another object of the present invention to provide a hand covering for use with firearms which includes a means for retaining the uninsulated trigger finger receiving stall adjacent the insulated finger receiving stall when the uninsulated stall is not in use.

In accordance with one aspect of the present invention, a hand covering is provided comprising an inner layer and an outer layer. The outer layer has first and second trigger finger receiving stalls. The inner layer has a single trigger finger receiving stall adapted to be received within the first trigger finger receiving stall of the outer layer. An opening is provided in the inner layer aligned with the second trigger finger receiving stall in the outer layer adapted to permit the trigger finger of the wearer to extend through the inner layer and into the second trigger finger receiving stall of the outer layer.

Means are provided for retaining the second trigger finger receiving stall adjacent the first trigger finger receiving stall when the second trigger finger receiving stall is not in use.

The hand covering preferably comprises the form of a six-fingered glove. The hand covering may also be a mitten in which the first trigger finger receiving stall receives the fingers of the wearer, other than the thumb.

The hand covering preferably further comprises an intermediate layer. The intermediate layer has first and second trigger finger receiving stalls. The first and second trigger finger receiving stalls of the intermediate layer are adapted to be received within the first and second trigger finger receiving stalls of the outer layer, respectively.

The volume of the second trigger finger receiving stall of the intermediate layer is preferably substantially smaller than the volume of the first trigger finger receiving stall of the intermediate layer. This is because the second trigger finger receiving stall of the intermediate layer is not designed to receive a relatively thick trigger finger receiving stall of the inner layer.

The intermediate layer is composed of a waterproof, gas permeable membrane. This membrane permits perspiration to evaporate without permitting water to penetrate the hand covering.

To these and to such other objects which may hereinafter appear, the present invention relates to a hand covering for use with firearms, as described in the following specification and set forth in the annexed claims, taken together with the accompanying drawings, wherein like numerals refer to like parts, and in which:

Figure 1:
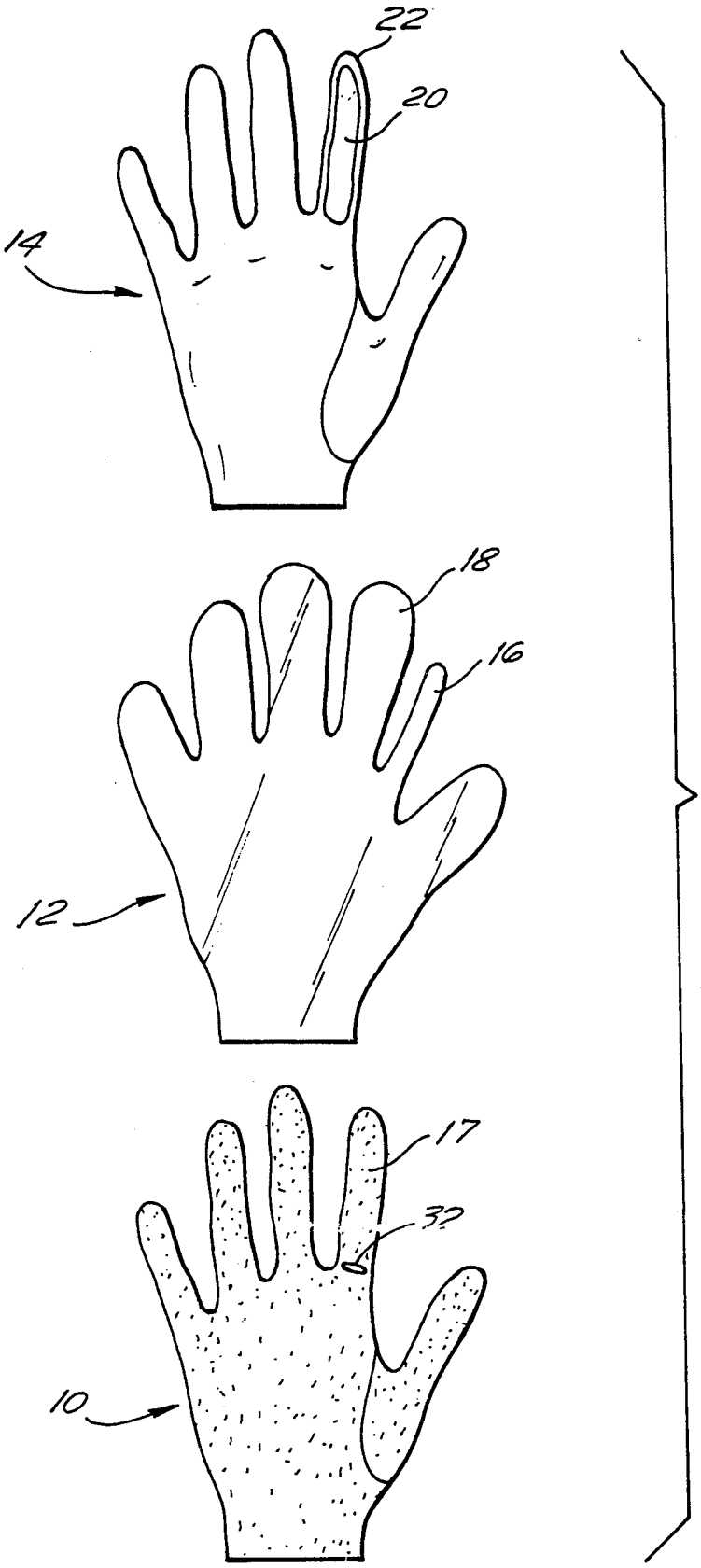
FIG. 1 is an exploded isometric view showing the layers of a first preferred embodiment of the present invention.

As seen in FIG. 1, the first preferred embodiment of the present invention comprises an inner insulating layer, generally designated 10, made of relatively thick heat insulating material such as Thinsulate or other commercially available material, which is the same in every respect as the corresponding layer in a conventional glove, except for opening 32 which is on the palm side of the layer, proximate the junction between trigger finger receiving stall 17 and the palm portion. Opening 32 is large enough to permit a finger to pass through.

Inner layer 10 is designed to be telescopically received within an intermediate layer, generally designated 12, which is preferably made of two very thin, flexible die-cut sheets of a waterproof, gas permeable membrane such as Gore-Tex, available from W. L. Gore Associates. One of the sheets will form the palm of the insert whereas the other will form the back. The sheets of Gore-Tex are heat sealed around the periphery to form a glove-like insert which has two trigger finger stalls 16 and 18.

The trigger finger stall 18 in layer 12, like all of the other finger receiving stalls in this layer, other than stall 16, are relatively large and, therefore, can easily receive therein the corresponding finger stalls of inner layer 10. While the volume of these finger receiving stalls is relatively large as compared to the volume of stall 16, the material from which layer 12 is made is so thin and flexible that these stalls fit easily into the corresponding stalls of the outer covering layer, generally designated 14.

Outer layer 14, which may be made of leather, vinyl or any other conventional material, has an additional trigger finger receiving stall 20, When intermediate layer 12 (and inner layer 10 therein) are received within outer covering layer 14, the respective finger stalls on intermediate layer 12 fit into the corresponding finger stalls on cover layer 14, trigger finger receiving stall 16 fitting into an additional trigger finger receiving stall 20.

Figure 3:
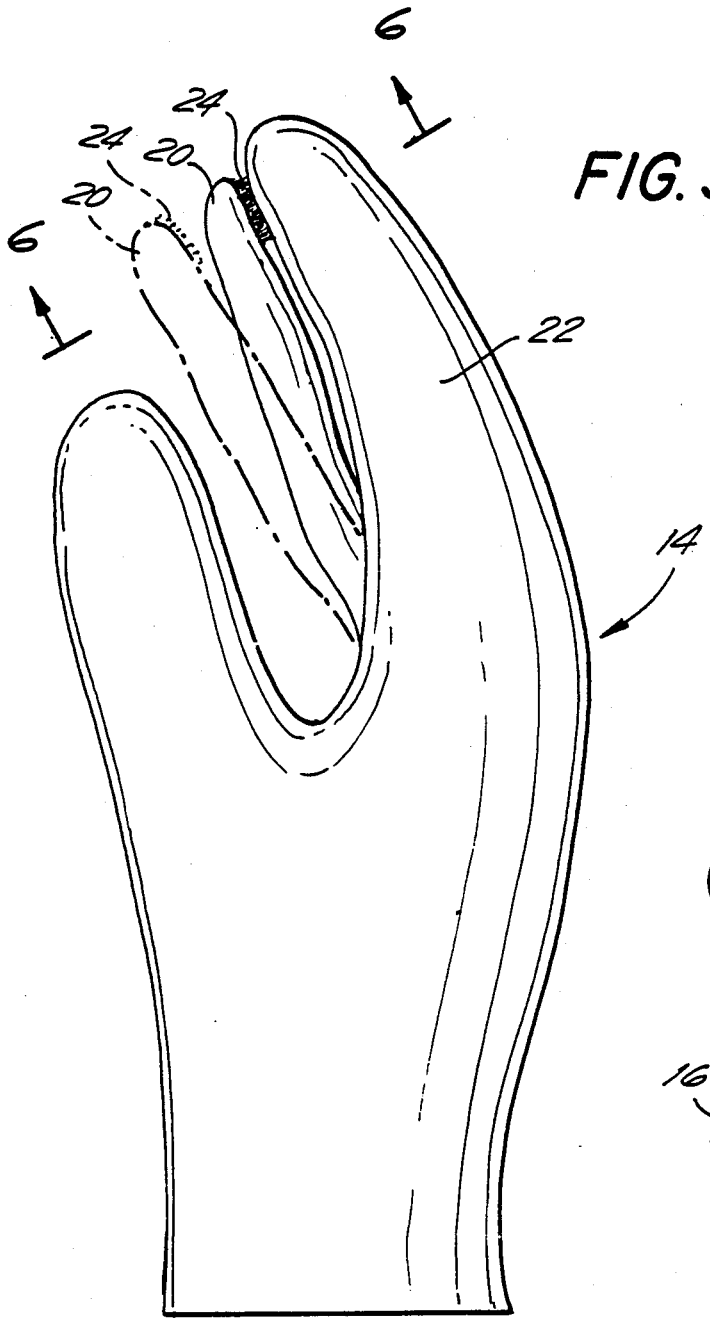
FIG. 3 is a side view of a first preferred embodiment of the present invention.
Figure 6:
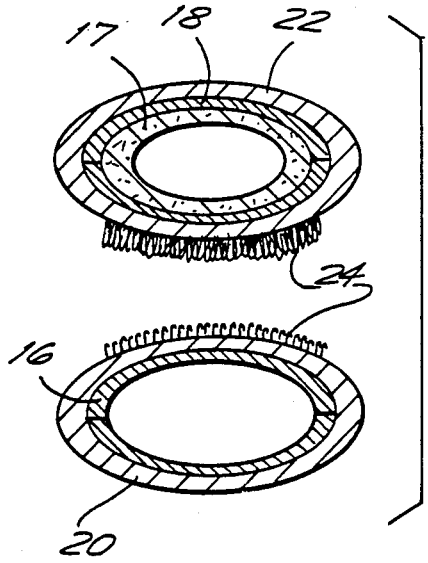
FIG. 6 is a cross-sectional view of the trigger finger stalls of the first preferred preferred embodiment of the present invention, taken along line 6—6 of FIG. 3.
Figure 4:
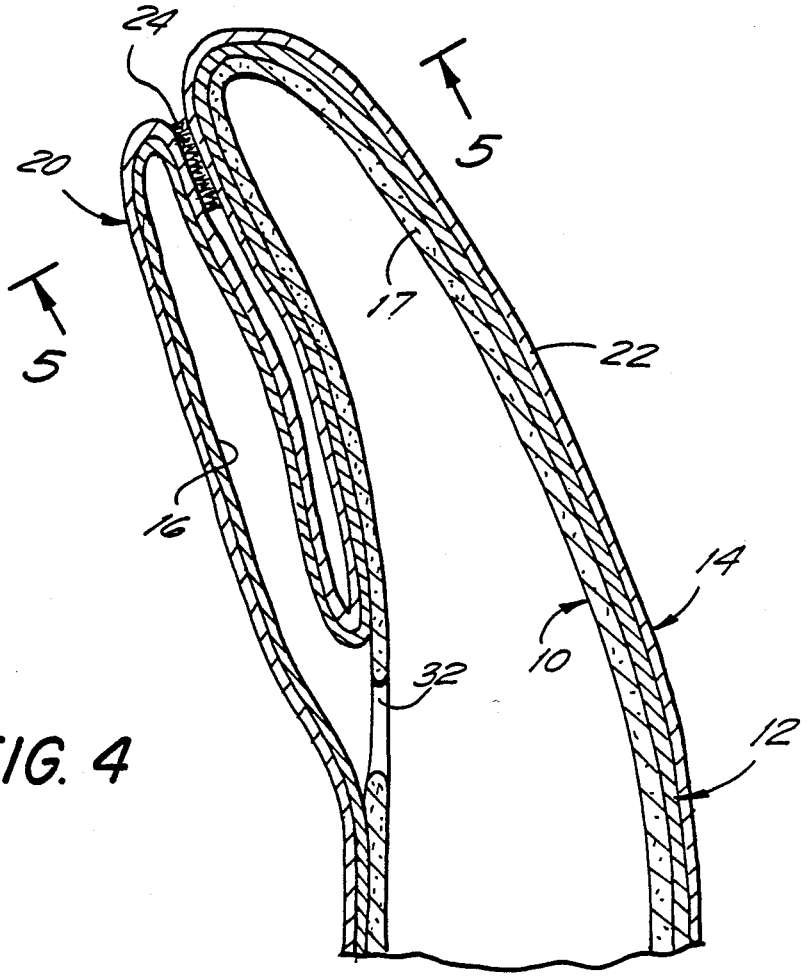
FIG. 4 is a cross-sectional view of the trigger finger portion of the first preferred embodiment of the present invention taken along line 4—4 of FIG. 2.
Figure 5:
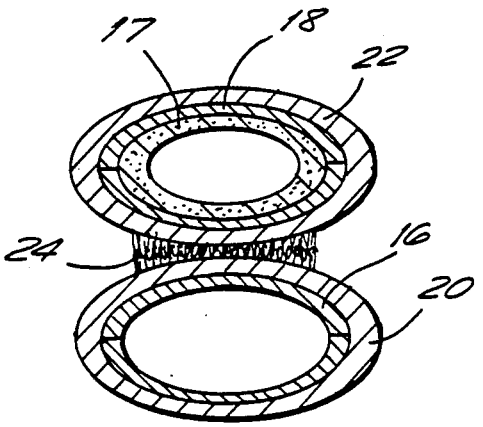
FIG. 5 is a cross-sectional view of the first and second trigger finger stalls of a first preferred embodiment of the present invention, taken along line 5—5 of FIG. 4.

As best seen in FIGS. 3 and 4, stall 20 extends from the palm portion of covering 14, generally parallel to the conventional trigger finger receiving stall 22. It should be noted that trigger finger receiving stall 22 is somewhat bigger than trigger finger receiving stall 20 as it must receive therein the trigger finger receiving stall 17 of inner layer 10, whereas trigger finger receiving stall 20 receives no insulating inner layer material therein—only stall 16 which is very thin.

Figure 2:
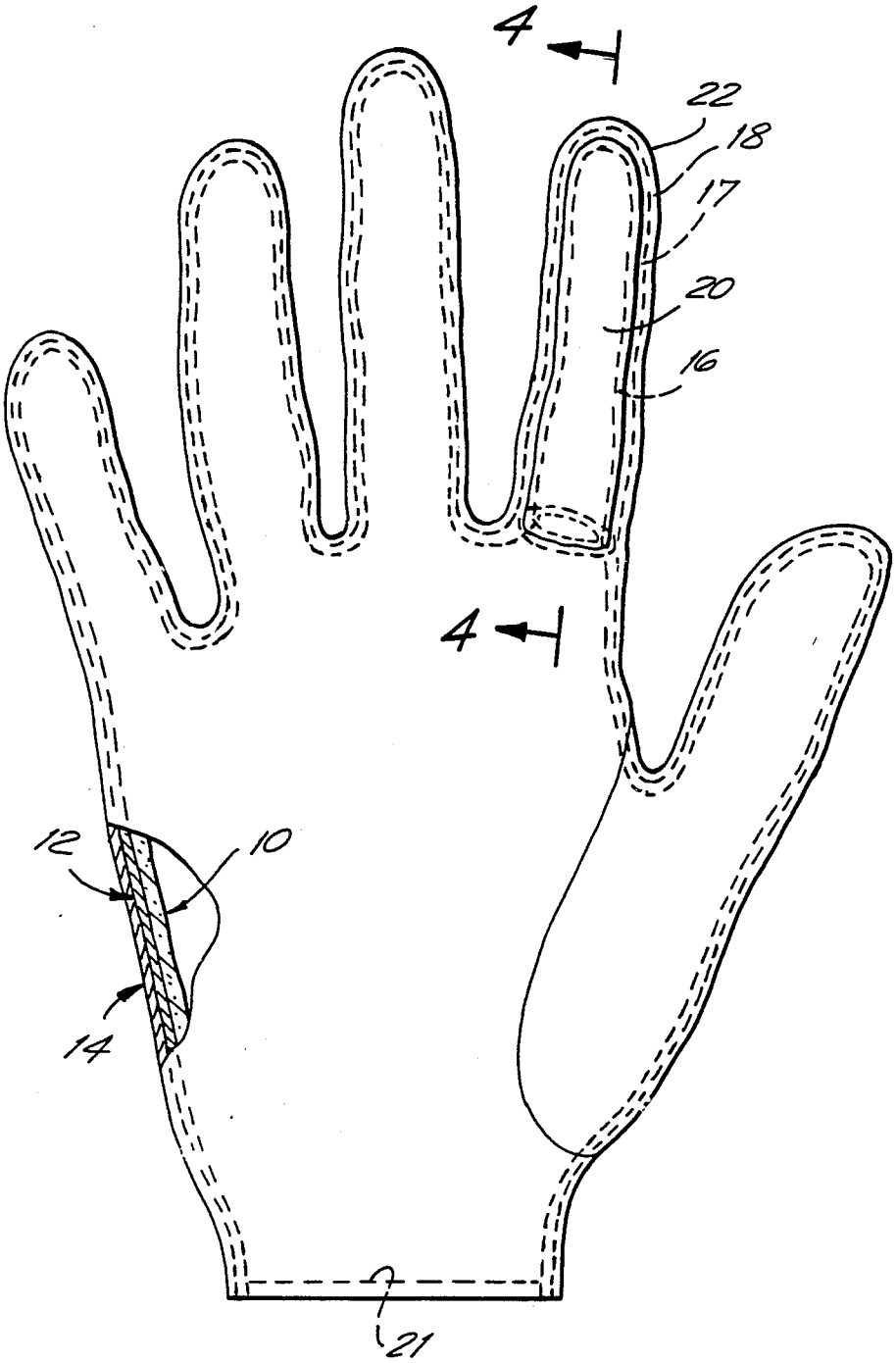
FIG. 2 is a front view of a first preferred embodiment of the present invention.

FIG. 2 illustrates a fully assembled glove in accordance with the present invention. Layers 10, 12 and 14 may be stitched along the wrist at 21, if desired, to hold same together.

This is best illustrated in FIG. 4 which shows a cross-sectional view of trigger finger receiving stalls 20 and 22. It can here be seen that trigger finger receiving stall 22 receives therein trigger finger receiving stalls 17 and 18 of the inner layer 10 and intermediate layer 12, respectively, whereas finger receiving stall 20 receives therein only trigger finger receiving stall 16 of intermediate layer 10.

As best seen in FIGS. 3 through 6, provision is made to removably attach the ends of trigger finger receiving stalls 20 and 22 such that trigger finger receiving stall 20, when it is not in use, will not flap around loosely. This can be done by a number of different types of removable retaining means, but is preferably accomplished through the use of a Velcro or similar material strip 24 which consists of a ribbon of hook-like fasteners attached to one of the stalls and a ribbon of eye-type fasteners attached to the other stall such that the stalls can be linked together or separated as required.

In use, the wearer places his/her fingers in the glove, with the trigger finger in trigger finger receiving stall 22, as is conventional. When it is desired to use a firearm, the hand is partially withdrawn from the glove. The trigger finger is extracted from stall 22 and inserted through opening 12 in inner layer 10 such that it is within stall 20. At this point, the attachment between the ends of trigger finger receiving stalls 20 and 22 may be opened. The trigger finger is now within a freely movable trigger finger receiving stall 20 of relatively thin material and can easily be manipulated.

While there is less heat insulating within trigger finger receiving stall 20 than the rest of the glove, there should be sufficient heat retention to keep the finger supple and protected for an extended period of time. After use, the hand is again partially withdrawn from the glove and the trigger finger extracted from trigger finger receiving stall 20 and inserted back into trigger finger receiving stall 22.

Figure 7:
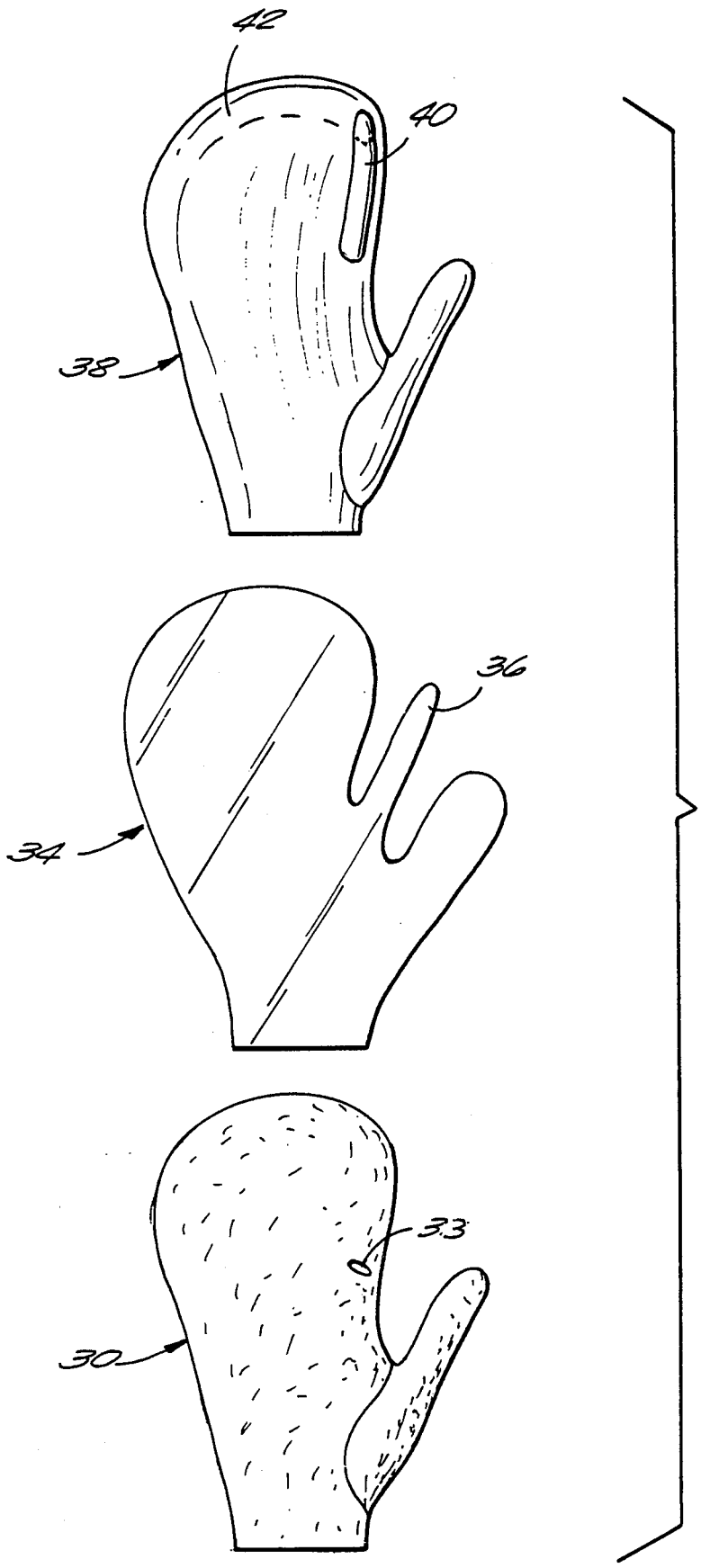
FIG. 7 is an exploded isometric view showing the layers of a second preferred embodiment of the present invention.
Figure 8:
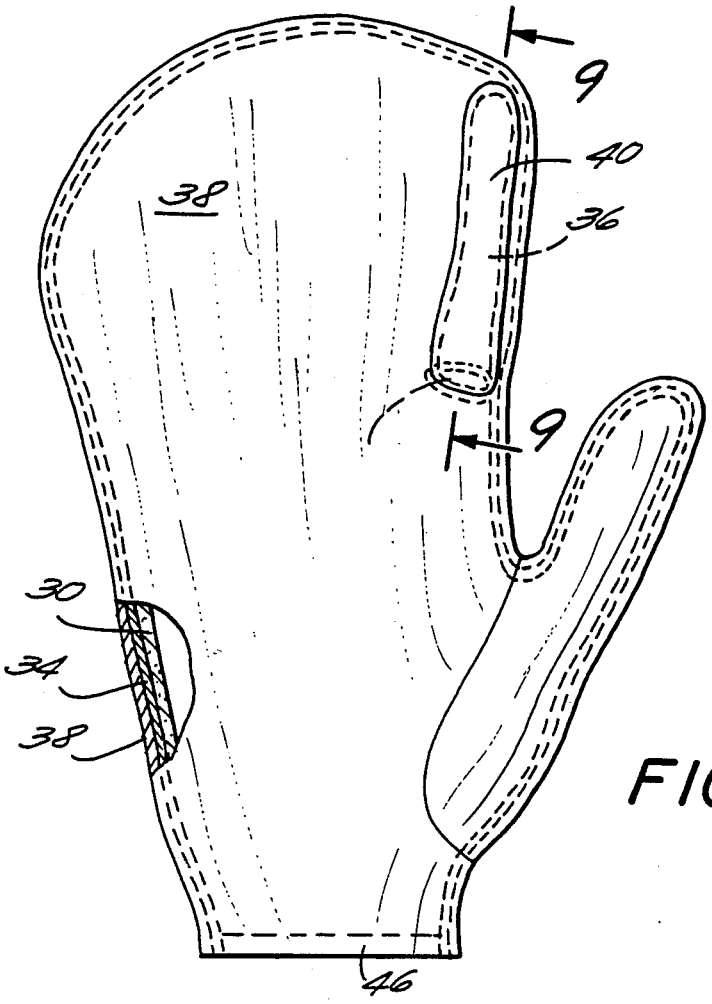
FIG. 8 is a front view of the second preferred embodiment of the present invention.
Figure 9:
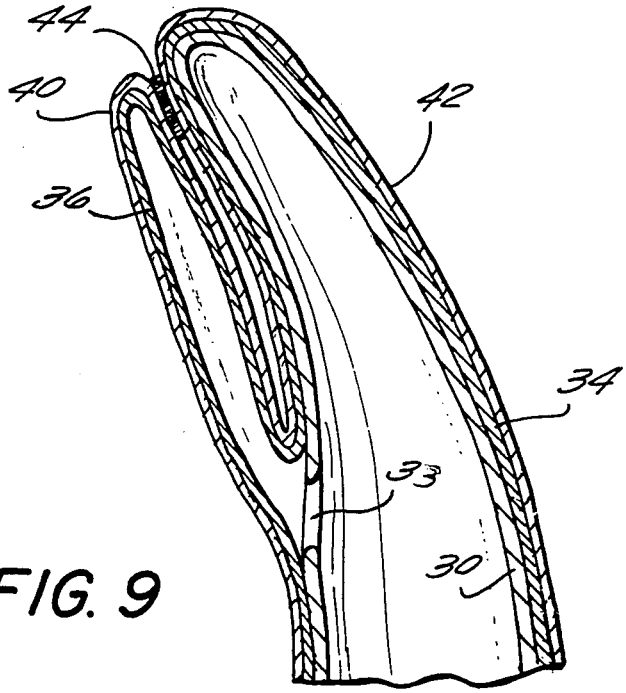
FIG. 9 is a side cross-sectional view of the second preferred embodiment of the present invention, taken along lines 9—9 of FIG. 8.

FIGS. 7 through 9 show a second preferred embodiment of the present invention which is in the form of a mitten. As shown in FIG. 7, the mitten has an inner insulating layer 30 which is made of the same relatively thick heat insulating material as layer 10 and, thus, the same as the inner layer of a conventional mitten. Layer 30 has an opening 33 through which the trigger finger can extend. Inner layer 30 is designed to be received within an intermediate layer 34, generally designated 34, which is made up of a pair of heat-sealed sheets of waterproof, gas-permeable membrane such as Gore-Tex, the same as layer 12. Layer 34 has an additional trigger finger receiving stall 36 which has a relatively small volume. The intermediate layer 34 and inner layer 30 assembly is telescopically received within an outer covering layer, generally designated 38, made of the same material as layer 14, which has the conventional mitten configuration except for an additional trigger finger receiving stall 40 into which the trigger finger receiving stall 36 of the intermediate layer 34 is received.

FIG. 8 shows the assembled mitten of the present invention. Opening 33 has a trigger finger receiving stall 36 of intermediate layer 34 extending therethrough. Stall 36 is received within trigger finger receiving stall 40 of outer layer 38. The layers are stitched together along the wrist at 46.

As best seen in FIG. 9, the end of trigger finger receiving stall 40 is removably attached to the finger stall 42 by means of a pair of Velcro strips 44 attached to the inner surface thereof. The trigger finger receiving stall 40 can thus be secured and not flop around when not in use.

The mitten of the second preferred embodiment of the present invention is used in the identical fasion as the previously described glove. The user wears the mitten in the conventional fashion until it is necessary to manipulate the firearm. At that time, the hand is withdrawn partially from the mitten and the trigger finger is removed from stall 42 and inserted through opening 33 into stall 40 which includes stall 36 therein. Stall 40 is separated from stall 42. The firearm can then be used. After the firearm has been used, the hand is again partially withdrawn and the trigger finger extracted from finger receiving stall 40 and placed back into finger receiving stall 42.

It should now be appreciated that the present invention relates to a hand covering, either in the form of a glove or mitten, which is provided with first and second trigger finger receiving stalls—one of which has a conventional amount of heat insulation and is therefore relatively bulky, and the other of which is relatively thin, lacking the conventional heat insulating layer, such that it can be easily manipulated. In this way, a firearm can be used expertly without interference from the hand covering and yet the hand can be protected from the environment.

While only a limited number of preferred embodiments have been disclosed herein for purposes of illustration, it is obvious that many variations and modifications could be made thereto. It is intended to cover all of these variations and modification which fall within the scope of the present invention, as defined by the following claims:

I claim:

1. A hand covering in the form of a six-fingered glove comprising an inner layer, an intermediate layer composed of substantially water proof, gas permeable material and, an outer layer, said inner layer being received within said intermediate layer, said intermediate layer being received within said outer layer, said intermediate layer and said outer layer each having first and second trigger finger receiving stalls, the volume of each of said second trigger finger receiving stalls being substantially smaller than the volume of the corresponding first trigger finger receiving stalls, said first and said second trigger finger receiving stalls of said intermediate layer being respectively situated within said first and said second trigger finger receiving stalls of said outer layer, said inner layer having a single trigger finger receiving stall situated within said first trigger finger receiving stall of said intermediate layer and an opening proximate said second trigger finger receiving stall of said intermediate layer.

2. The hand covering of claim 1, further comprising means for retaining said second trigger finger receiving stall adjacent said first trigger finger receiving stall.

* * * * *